United States Patent [19]

Meyer

[11] 3,958,381

[45] May 25, 1976

[54] CONCRETE FILLED TAPERED TUBULAR TOWER

[75] Inventor: Roy E. Meyer, Red Wing, Minn.

[73] Assignee: Meyer Industries, Inc., Red Wing, Minn.

[22] Filed: Jan. 20, 1971

[21] Appl. No.: 107,985

[52] U.S. Cl. ..... 52/303; 52/1; 52/40; 52/725; 52/731

[51] Int. Cl.² ..... E04C 3/34; E04H 12/12

[58] Field of Search ..... 52/2, 725, 720, 731, 52/1, 40, 303

[56] References Cited

UNITED STATES PATENTS

| | | | |
|---|---|---|---|
| 973,814 | 10/1910 | Robinson | 52/725 X |
| 1,971,051 | 8/1934 | Reiner et al. | 52/725 X |
| 3,217,459 | 11/1965 | Meyer | 52/731 |
| 3,469,358 | 9/1969 | Archer et al. | 52/2 X |
| 3,514,918 | 6/1970 | Archer et al. | 52/725 X |

FOREIGN PATENTS OR APPLICATIONS

| | | | |
|---|---|---|---|
| 1,188,509 | 3/1959 | France | 52/2 |

*Primary Examiner*—Alfred C. Perham
*Attorney, Agent, or Firm*—James R. Haller; H. Dale Palmatier

[57] ABSTRACT

A tower supporting loads at heights up to 180 feet and higher, the tower being tubular and tapered convergently in an upward direction, the tower being filled with concrete throughout a major portion of the height.

1 Claim, 5 Drawing Figures

INVENTOR.
ROY E. MEYER
BY Williamson, Palmatier & Bains ATTORNEYS

CONCRETE FILLED TAPERED TUBULAR TOWER

BACKGROUND OF THE INVENTION

Various types of loads must be supported at extremely high elevations. High voltage power transmission lines and lighting systems are typical of such loads. The extremely high towers were first used in connection with transmission lines, and originally lattice type towers were used, and these towers have been rather satisfactory from a structural standpoint, but are aesthetically unsightly. Tubular towers made of steel plate material have been used in substitution for the lattice type towers, both for supporting transmission lines and lighting systems. The tubular towers provided some advantages structurally as compared to the lattice towers, and have provided substantial improvement over the lattice towers from an aesthetic standpoint; and the tubular towers have been wholly satisfactory from the strength and structural standpoint.

As it has been necessary and desirable to support transmission line and lighting system loads at higher and higher locations, the towers must be accordingly higher and higher. Some of the aesthetic advantages of the tubular steel towers is lost as the height of the towers increases because the base areas of the tubular towers must increase to substantial dimensions, and it has been experienced in the recent past that towers of approximately 180 feet in height must be approximately 9 feet across at the base.

One of the critical design requirements in tubular towers is the magnitude of tension under conditions of maximum wind loading tending to bend or bow the tower transversely from its normal perfectly upright position. Of course, the structural steel plate material which is used in fabrication of the tower must be able to withstand the maximum tension loads thereby applied.

It should be understood that when a tubular tower is wind loaded, and the tower is flexed in response to the pressure of the wind, the sheet steel in the windward side of the tower is under tension, and the sheet steel in the leeward side of the tower is under compression; and the sheet steel in the tubular tower, at locations along a plane facing windward and substantially extending through the tower axis, has shear stresses applied, these being the locations where the tensile forces change to compressive forces in the sheet steel. In general, it is considered that approximately half the sheet steel in the tubular tower is under tension and half under compression. When the bowing or bending of the tower causes deformation of the sheet steel, particularly where the sheet steel is under tension, beyond the elastic limits of the material, a permanent deformation is obtained, and the tower will no longer return to its desired exactly upright original position.

As a result of this possibility of permanent deformation, the tower must be extremely strong and broad at its base so as to withstand the maximum wind loading.

BRIEF SUMMARY OF THE INVENTION

The tapered tubulr tower is constructed of steel and the tower is filled with concrete. The tubular tower may have any of a variety of cross-sectional shapes, and may be smoothly curved or rounded, or may be flat sided. The tower may be generally elliptical in cross-sectional shape with the major and minor axes either of equal or unequal lengths as the requirements of the tower may dictate.

DETAILED DESCRIPTION OF THE INVENTION

Figure 1:
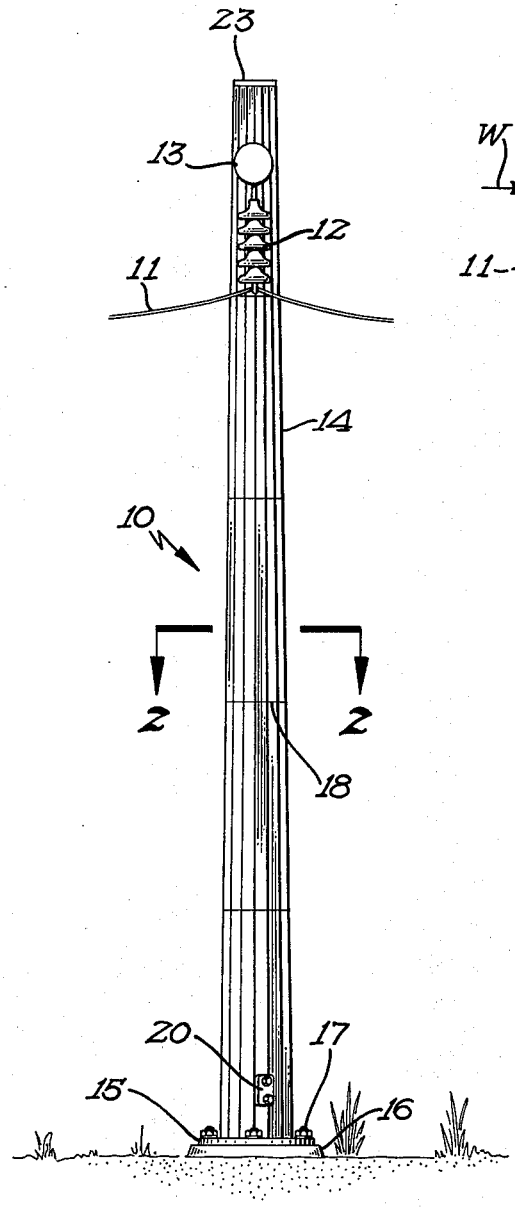
FIG. 1 is an elevation view of a tower incorporating the present invention and shown supporting a transmission line.

The tower 10 illustrated in FIGS. 1 - 4, serves the purpose of supporting high voltage electric power transmission lines 11 which are supported by insulators 12 suspended from a cross arm 13.

The tower 10 has a tubular standard 14 which is tapered convergently from the base plate 15 and in an upward direction toward the upper end. The base plate 15 is affixed as by welding to the tubular standard 14 and facilitates attachment of the tower to a base 16 in the ground. The base 16 has suitable anchor bolts 17 which are secured to the base plate 15 as by large threaded nuts.

The tubular standard 14 is fabricated of sheet steel or steel plate which has high tensile strength according to the requirements of the particular tower being constructed. In some instances the steel plate in the standard 14 may have a thickness in excess of one inch. The thickness of the sheet steel in the standard 14 will be less in the upper portions of the standard than in the lower portions of the standard.

Figure 2:
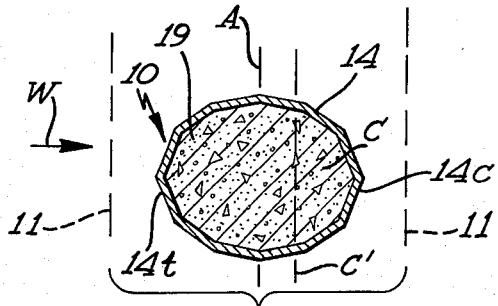
FIG. 2 is an enlarged cross section view taken approximately at 2—2 in FIG. 1.
Figure 3:
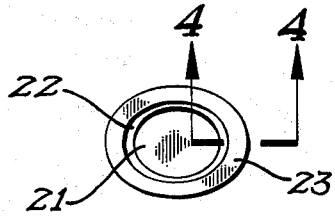
FIG. 3 is an enlarged top plan view of the tower in FIG. 1.

As seen in FIGS. 1 and 2, the standard 14 is generally oblong in shape and has a plurality of flat sides lying at oblique angular relation with each other. The standard 14 is fabricated from a plurality of sections of the suitably formed sheet steel, and these sections are welded together as at 18 to cumulatively form the tapered tubular standards 14.

A concrete core 109 is provided in the tapered tubular standard 14. The concrete core fills the entire cross section of the tapered standard 14 and is rigid relative to the interior periphery of the tapered standard 14. Preferably, the concrete core 19 extends substantially throughout the entire height of the standard 14, but certainly the core 19 should at least extend throughout a major portion of the height of the tapered standard 14.

The concrete in the core 19 is pumped into the standard 14 after the standard is erected on the base 16, the concrete being pumped through a port in the side of the standard which is normally covered by cover plate 20. The concrete is pumped into the base portion of the standard 14 and the tapered tubular standard is gradually filled by the concrete being pumped therein.

Figure 4:
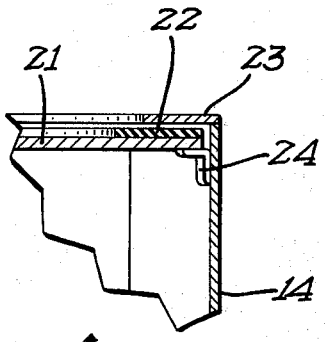
FIG. 4 is an enlarged detail section view taken approximately at 4—4 in FIG. 3.

The top of the standard 14 is provided with a valve plate 21 having an annular gasket 22 around the periphery thereof to seal against a sealing flange 23 affixed as by welding to the top edge of the standard 14. As the concrete is being pumped into the standard 14, air is permitted to escape around the edge of the valve plate 21 which is supported on angle clips 24 welded to the standard 14, and when the concrete reaches the level of the valve plate 21, the concrete itself forces the valve plate 21 upwardly against the flange 23 so as to prevent any spillage of the concrete over the top edge of the standard 14 to thus prevent any unsightly appearance of the standard and the tower and as to provide an indication that the standard is entirely filled with concrete due to an increase in pressure at the filling port. FIG. 4 is illustrated without concrete so that the details of the valve plate can be made clear, but ordinarily in the tower as completed as in FIG. 1, the upper portion of the standard 14 will be entirely filled with concrete.

Figure 5:
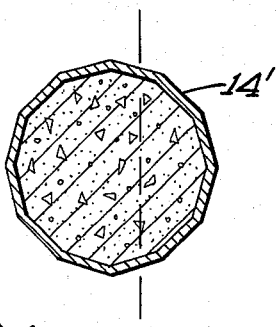
FIG. 5 is an enlarged cross section view of a modified form of tower.

FIG. 5 illustrates that the standard may have a different cross-sectional shape, depending upon the use to which the tower is put, and in FIG. 5 the standard 14' has an overall circular shape with the multi-sided formation. It will be understood that the tower might also be smoothly rounded rather than multi-sided, or may be oblong and smoothly rounded. However, in each instance, regardless of the cross-sectional shape, it is considered important that the tower be tapered convergently from the bottom toward the top.

In the oblong shape illustrated in FIG. 2, the wind loading of the tower and the transmission lines will generally be maximum in the direction transversely of the transmission line as indicated by the arrow W.

With the wind load in the direction of the arrow W, the area C, to the leeward side of upright plane C' facing the windward direction, is adequate to accept, together with the adjoining portion of the steel plate 14*c*, also to the right of the plane C', the entire compressive load created due to the maximum deflection caused by wind loading. As a result, all of the remainder of the standard 14 is under a tensile load, as indicated by the numeral 14*t*. The portion 14*t* of the standard under tension due to wind loading W extends all around the periphery of the standard to the left of the plane C' (rather than merely that portion of the standard which is to the left of the minor axis A as is the case without the concrete core), i.e., a greater proportion of the periphery of the standard 14 is under tension due to wind loading because of the presence of the concrete core because the concrete core, at the area C, together with the adjoining portion 14*c* of the standard accept the entire compressive load due to the wind loading and bending or bowing of the tower.

As a result, the steel tubular tapered standard 14 may have a smaller size, both as to breadth and thickness of the steel if the concrete core is utilized according to the present invention, than if the concrete core is omitted. Of course, the smaller dimensions makes a material improvement in the aesthetic and in the lower cost of the materials involved. Because of the tapered shape of the standard 14 and of the core 19 of concrete, there is no slippage between the core and the standard 14 when the standard bows under wind loading. Because of this tapered configuration, there is no need for interior clips or other devices to retain the concrete core 19 stationary relative to the standard 14.

It has been determined that the concrete core is responsible for adding between 60 and 75 percent more strength to the same tower. As a result, for a tower of a certain height, the use of a concrete core in the tower makes it possible to utilize a tower having considerably smaller dimensions across the width of the tower at the base and throughout the entire height of the tower. For instance, in towers of a particular height and requiring a base of 60 inches across without the concrete core, a similar tower of the same height and with a concrete core will require a dimension across the base of approximately 48 inches.

Although the particular illustration described in connection with the operation and function of this tower was presumed to be oblong in shape as illustrated in FIG. 2, the same advantages are obtainable in a generally round but multi-sided tower as illustrated in FIG. 5, or in a round and smoothly contoured tower.

It will be understood that I have provided a new and improved tower for supporting equipment such as high voltage transmission lines or lighting systems, at elevated positions of 180 feet or more and wherein the use of the concrete core in a tapered tubular standard obtains additional strength to resist wind loading so that a tower of substantially lesser cross-sectional dimensions need be used to support the equipment at a comparable height as compared to prior art towers.

What is claimed is:

1. A tower to be supported on a base to carry a load at an elevated location comprising a free-standing upright standard of tubular construction and being constructed of high tensile strength steel plate, the standard being tapered convergently in an upward direction, and having an interior surface free of inward protuberances, the tubular standard having a cross-sectional shape with a plurality of flat wall segments in each quadrant, each of said wall segments being oriented at obtuse angles with respect to adjoining wall segments, and a concrete core in the tapered tubular standard and bearing against the inner periphery of the stnadard, the periphery of the core having a plurality of flat surfaces in each quadrant and oriented at obtuse angles with respect to adjoining wall segments, the flat peripheral surfaces of the core lying against the corresponding flat wall segments of the tubular standard and minimizing any deformation of the wall segments as the standard flexes under various loadings of the tower tending to bow and twist the standard, and a normally open valve at the top of the tubular standard and having a pressure responsive means to close as concrete fills the standard to the top.

* * * * *